US010822766B1

(12) United States Patent
Friesen

(10) Patent No.: US 10,822,766 B1
(45) Date of Patent: Nov. 3, 2020

(54) MANHOLE SADDLE TEE

(71) Applicant: Predl Systems North America Inc., Burnaby (CA)

(72) Inventor: Jed Christopher Friesen, Vancouver (CA)

(73) Assignee: Predl Systems North America Inc., Burnaby (CA)

( * ) Notice: Subject to any disclaimer, the term of this patent is extended or adjusted under 35 U.S.C. 154(b) by 0 days.

(21) Appl. No.: 16/556,084

(22) Filed: Aug. 29, 2019

Related U.S. Application Data

(60) Provisional application No. 62/724,496, filed on Aug. 29, 2018.

(51) Int. Cl.
*E02D 29/12* (2006.01)
*E03F 5/02* (2006.01)

(52) U.S. Cl.
CPC ..... *E02D 29/12* (2013.01)

(58) Field of Classification Search
CPC ..... E02D 29/12; E02D 29/121
See application file for complete search history.

(56) References Cited

U.S. PATENT DOCUMENTS

| | | | |
|---|---|---|---|
| 541,987 | A | 7/1895 | Whiteside |
| 1,712,510 | A | 5/1929 | Monie |
| 1,955,018 | A | 4/1934 | Rego |
| 2,025,839 | A | 12/1935 | Woods |
| 2,030,536 | A | 2/1936 | Rego |
| 2,254,668 | A | 9/1941 | Tomek |
| 2,681,494 | A | 6/1954 | Weber |
| 3,331,295 | A | 7/1967 | Sorrell |
| 3,370,386 | A | 2/1968 | Martin |

(Continued)

FOREIGN PATENT DOCUMENTS

| | | | |
|---|---|---|---|
| DE | 817419 | C | 10/1951 |
| EP | 2604758 | B1 | 4/2014 |
| JP | 2006090047 | A | 4/2006 |

OTHER PUBLICATIONS

Fernco Inc., "Fernco Saddle", https://www.google.ca/search?q=fernco+saddle&client=safari&hl=en-ca&prmd=sivn&source=Inms=isch&sa=X&ved=2ahUKEwibgZ2dhPLkAhXWsJ4KHaosDjkQ_AUoAnoECA4QAg&biw=375&bih=bih=635&dpr=3, accessed Sep. 27, 2019, 3 pages.

(Continued)

*Primary Examiner* — Benjamin F Fiorello
(74) *Attorney, Agent, or Firm* — Schacht Law Office, Inc.; Dwayne Rogge

(57) ABSTRACT

An apparatus and an associated method of installing a manhole assembly upon a pipe is disclosed herein. One example of the method comprises the steps of: exposing a joining section of the pipe; cutting a pipe access hole in the joining section. One prepared, a saddle may be positioned adjacent the perimeter surface of the hole such that the seal is positioned between the saddle and the joining section. The saddle in one example having a surface defining a saddle access hole there through, the saddle access hole substantially aligned with the pipe access hole during installation. The method may include the step of encapsulating these structures with a grouting material such as concrete or an equivalent. The method may include the step of providing a riser having a bottom surface resting upon the support surface of the spigot and a radially inward surface engaging the alignment surface.

7 Claims, 4 Drawing Sheets

(56) References Cited

U.S. PATENT DOCUMENTS 3,462,896 A 8/1969 Lokensgaard
3,477,106 A 11/1969 Tetzlaff et al.
3,533,199 A * 10/1970 Pickett ..... E02D 29/121 52/20
3,715,958 A * 2/1973 Crawford ..... E02D 29/12 52/21
3,787,078 A 1/1974 Williams
3,965,233 A 6/1976 Ritter
4,102,088 A 7/1978 Keller et al.
4,119,291 A 10/1978 Polito
4,123,033 A 10/1978 Joelson
4,127,990 A 12/1978 Morrow
4,275,757 A 6/1981 Singer
4,318,880 A 3/1982 McIntosh et al.
4,346,921 A 8/1982 Gill et al.
4,372,017 A 2/1983 Heckethorn
4,419,231 A 12/1983 Friedl
4,422,994 A 12/1983 Ditcher
4,591,290 A 5/1986 Prescott
4,621,941 A * 11/1986 Ditcher ..... E02D 29/14 404/25
4,682,907 A 7/1987 Gaudin
4,776,138 A 10/1988 Sumner et al.
4,927,290 A 5/1990 Bowman
5,017,313 A 5/1991 Trimble
5,081,802 A 1/1992 Westhoff et al.
5,100,697 A 3/1992 Nielsen
5,261,766 A 11/1993 Anderson
5,263,298 A 11/1993 Ballesteros
5,303,518 A 4/1994 Strickland
5,308,192 A * 5/1994 Srackangast ..... F16L 25/12 285/15
5,360,131 A 11/1994 Phillipps et al.
5,386,669 A * 2/1995 Almeida ..... E02D 29/12 220/560.01
5,413,307 A 5/1995 Tidwell
5,451,081 A 9/1995 Kaucnik
5,536,420 A * 7/1996 Oyzboyd ..... C02F 3/223 210/609
5,549,411 A 8/1996 Hawkins
5,564,860 A 10/1996 Amann
5,979,117 A 11/1999 Fuller
6,385,913 B1 * 5/2002 Ahn ..... E02D 29/12 220/4.12
6,393,771 B1 5/2002 Stetson
6,457,901 B1 10/2002 Sondrup
6,746,178 B1 * 6/2004 Hensley ..... B60R 15/00 138/110
6,851,225 B1 2/2005 Haar et al.
7,347,644 B2 3/2008 Meyers
7,473,373 B1 * 1/2009 Danler ..... E03F 1/00 210/162
7,695,213 B1 4/2010 Akkala et al.
7,748,926 B2 7/2010 Jurich et al.
8,851,789 B2 10/2014 Bax
9,011,035 B2 4/2015 Munro
9,175,705 B1 11/2015 Clark, Jr. et al.
9,890,513 B1 2/2018 Wu et al.
10,138,615 B2 11/2018 Kim et al.
10,214,893 B2 * 2/2019 Skinner ..... B28B 19/0038
10,294,627 B2 5/2019 Bechler et al.
10,344,447 B2 7/2019 Sauve et al.
10,442,617 B1 10/2019 Holbrook
10,458,093 B2 10/2019 Gilbert
10,563,373 B1 * 2/2020 Friesen ..... E02D 29/127
10,662,606 B1 * 5/2020 Friesen ..... E02D 29/124
10,689,834 B2 6/2020 Levesque
2005/0100412 A1 * 5/2005 Houck ..... E03F 3/046 405/124
2006/0065994 A1 3/2006 Zotto
2007/0053747 A1 * 3/2007 O'Brien ..... B65D 90/105 405/53
2011/0013991 A1 1/2011 Watson et al.
2012/0141210 A1 * 6/2012 Kiest, Jr. ..... E02D 29/125 405/150.2
2013/0336723 A1 * 12/2013 McKinney ..... E02D 29/121 405/129.55
2016/0097180 A1 * 4/2016 Pesonen ..... E02D 29/1409 404/26
2016/0145848 A1 * 5/2016 Skinner ..... E02D 29/125 52/20
2018/0305888 A1 * 10/2018 Bonell ..... E02D 29/149
2020/0217037 A1 7/2020 Friesen

OTHER PUBLICATIONS

Hobas, "Hobas Tee Manhole", https://www.google.ca/search?q=hobas+tee+manhole&client=safari&hl=en-ca&prmd=isnv&source=Inms&tbm=isch&sa=X&ved=2ahUKEwiR19vEhPLkAhUNvp4KHTVFBpYQ_AUoAXoECAsQAQ&biw=375&bih=635, accessed Sep. 27, 2019, 9 pages.
National Liner, "The 3S Segment Panel System: for the structural rehabilitation and restoration of storm sewers, sanitary sewers, sanitary sewers and culverts", https://www.nationalliner.com/portals/0/pdf/3-pannel-system.pdf, accessed Nov. 5, 2019, 4 pages.
National Precast Concrete Association, "Watertight Manhole Joints," Jun. 2013, 4 pages.

* cited by examiner

MANHOLE SADDLE TEE

RELATED APPLICATIONS

This application claims priority benefit of U.S. Ser. No. 62/724,496 filed Aug. 29, 2018, the contents of which are incorporated herein by reference.

BACKGROUND OF THE DISCLOSURE

Field of the Disclosure

This disclosure relates to the field of manhole comprising a base which is cast in place at the location of the manhole, optionally on an existing pipe.

BRIEF SUMMARY OF THE DISCLOSURE

Examples of a manhole assembly comprising in one example a manhole saddle tee. Also disclose is an associated method of installing the manhole assembly. The manhole saddle tee disclosed in one example with one installation method which may comprise several steps, not necessarily required in the order described, and not all steps are required.

In one example, it is often desired to install a new manhole assembly onto an existing pipe previously installed where the ends of the pipe are not available at the location where the manhole is desired. In other examples, the disclosed system may be used to ease in installation of a pipe and manhole at a location for various reasons including time available, cost, manpower, equipment available, etc.

In one example, the method for installing a manhole saddle tee disclosed herein comprises the steps of: exposing an exterior surface of pipe. This section referred to as a "joining section" for clarity in this disclosure. The process also comprising the step of cleaning the joining section of contaminates; cutting a pipe access hole in the pipe joining section to allow access to the interior of the pipe through the manhole saddle tee to be attached over the access hole. To ensure that fluids (water intrusion nor sewage leakage) do not pass the joint between the saddle and the pipe, a seal may be applied to the pipe around the perimeter surface of the pipe access hole. The saddle tee as disclosed herein is then connected exterior of the access hole, in contact with the seal (if present) to ensure fluids do not pass therebetween. When used, this seal may be mastic or other material.

Once prepared, the method of installing the manhole tee may include a step of positioning a saddle adjacent the perimeter surface of the pipe access hole. When a seal is used, the saddle is arranged such that the seal is positioned between the saddle and the joining section of the pipe. The saddle in one example having a surface defining a saddle access hole there through as will be disclosed. The saddle access hole aligned with the pipe access hole during installation to ensure maximum fluid flow through the assembly and reduce or eliminate fluid flow past the joint.

The saddle in one example having a spigot in an upper portion thereof. The spigot comprising a support surface and a radially outward facing alignment surface. There term spigot here referring to a structure that enters the end of a pipe to form a joint.

The saddle in one example having a flange in a lower portion thereof covering a perimeter surface of the pipe access hole. The method may include the step of encapsulating an exterior surface of the flange and the exposed exterior surface of the pipe with a grouting material such as concrete or an equivalent. These steps forming a base of the manhole assembly. The method may include the step of providing a riser having a bottom surface resting upon the support surface of the spigot and a radially inward surface engaging the alignment surface.

The method disclosed herein may further comprise the steps of drilling substantially cylindrical holes in the section of pipe; tapping the holes so as to form female threads therein; and installing male threaded bolts through a flange of the saddle into the substantially cylindrical holes in the section of pipe.

The method as recited herein may alternatively comprise the steps of installing a clamp around the saddle and the pipe, and radially tensioning the clamp so as to affix the saddle to the pipe.

The method as recited may include a step wherein the clamp is a saddle clamp. Such a saddle clamp comprising a first portion and a second portion tensioned by way of one or more tensioning members. In one example, the first portion and/or second portion may be coupled to or formed with the saddle.

The method as recited herein may alternatively be arranged wherein the clamp is a pipe clamp. A tensioning member is used to reduce the circumferential size of the pipe clamp and secure the saddle to the pipe.

DETAILED DESCRIPTION OF THE DISCLOSURE

In the field of manhole assemblies, it is customary to install manholes at a site at the same time that connecting (transmission) pipes are installed. Often these manholes comprise inlets, and once the manhole assembly is installed in an excavation (hole in the ground) at a site the connecting (inlet and outlet or transmission) pipes are attached to the manhole assembly and the excavation is backfilled. One such apparatus is disclosed in U.S. Pat. No. 1,712,510.

Problems arise where a transmission pipe is already present at a site, and a manhole is needed at the site. In such an application using known methods a large excavation is needed to access a large longitudinal length of the transmission pipe, or other accommodations must be made for a secure installation of a manhole.

Wherein such manholes are often provided in or near roads, the weight of vehicles driving over the manhole assembly create stress on the manhole, and on the transmission pipe which the new manhole is installed. In such applications, it is generally desired to transmit the force incurred by the weight of the manhole assembly, vehicles, etc. around or past the transmission pipe(s) rather than incurring compression pressure through the transmission pipe(s) which may cause failure of the entire assembly including the transmission pipe and manhole.

Disclosed herein is a method for installing a manhole assembly 20 upon a previously installed pipe 22 which in one example is buried or otherwise established in the ground 24 or otherwise not easily accessible prior to installation of the manhole. In some applications, the pipe 22 has been in use for some time prior to installation of the manhole assembly 20.

Figure 5:
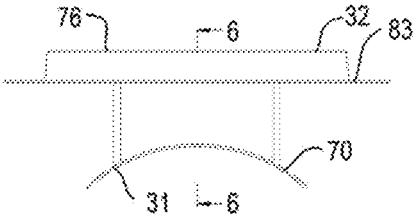
FIG. 5 is a side view of the saddle component shown in FIG. 4.
Figure 6:
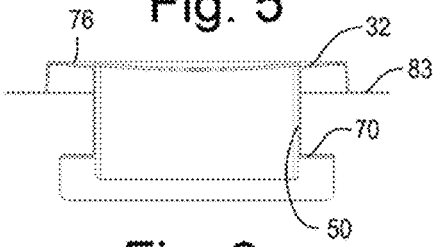
FIG. 6 is a cutaway view of the saddle component shown in FIG. 5 taken along line 6-6.
Figure 10:
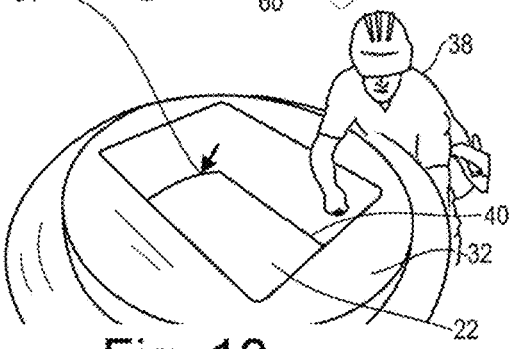
FIG. 10 is a highly schematic environmental view of a first stage of installation.
Figure 12:
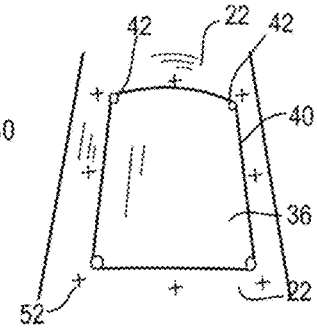
FIG. 12 is a highly schematic environmental view of a third stage of installation.

To install a manhole assembly 20 to a previously installed pipe 22 using the new method and apparatus (manhole assembly 20), an excavation 26 or hole in the ground 24 may be required to expose a joining section 28 of pipe 22 to which the manhole assembly 20 is to be affixed. The joining section 28 being that portion of the pipe 22 to which the manhole assembly 20 is to be directly affixed. To ensure a proper seal and to ensure that contaminants do not enter the pipe 22 during installation, the joining section 28 or a substantial portion thereof may be cleaned of contaminants such as dirt, oil, water etc. prior to cutting an access hole 30 in the pipe 22. Once this cleansing is complete, to ensure the proper size access hole 30 is formed through the pipe 22, the saddle 32 or a template thereof may be temporarily placed onto the joining section 28 of the pipe 22 as shown in FIG. 10. In this figure, the saddle 32 or a similar template may be placed on the pipe 22 to mark where the pipe 22 is to be cut to form the access hole 30 and any fastening holes that may be desired. In FIG. 5 the surface 31 of the saddle 32 engaging the outer surface of the pipe 22 may be curved to conform to the outer surface of the pipe 22. A marking implement 34 such as a pen, a marker, a pencil, a grease marker, may then be used to place a mark 36 such as a line, scratch, or scoring, on the pipe 22 as shown in FIG. 12 to indicate where the pipe access hole 30 is to be made by cutting, milling, or otherwise removing a section of the pipe 22. For ease in overall construction, the saddle 32 may be cast or otherwise manufactured off-site, meaning not at the same location as the excavation or installation location. The saddle may be formed in a mold, form, cast, extruded, one-off constructed, or otherwise produced. Testing has shown that a fiberglass reinforced plastic (FRP) saddle with a corrosive-resistant liner is easily produced and installed.

Before continuing, an axes system 10 is disclosed comprising a vertical axis 12 and a lateral radial axis 14. The lateral radial axis 14 is substantially centered upon the longitudinal axis of the manhole assembly 20 and projects laterally outward therefrom orthogonal to the longitudinal axis of the manhole assembly 20. Also disclosed is a transverse radial axis 16 substantially centered upon the longitudinal axis of the pipe 22 and extending radially therefrom. Lastly is disclosed a circumferential axis 18 which is tangential to the outer surface of the pipe 22 in a plane orthogonal to the longitudinal axis of the pipe 22.

Figure 3:
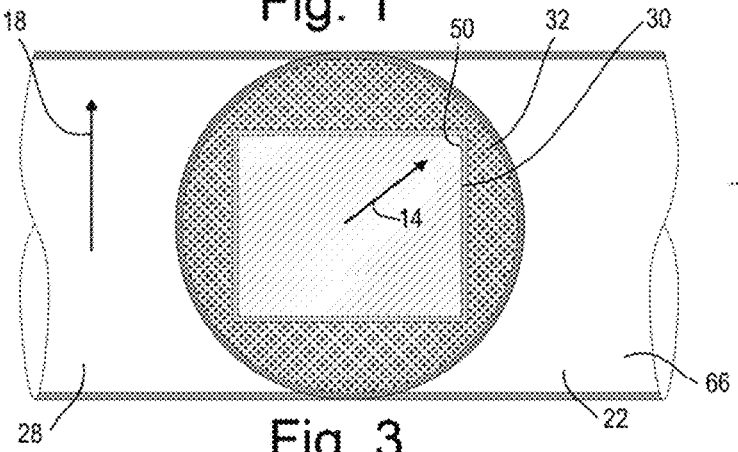
FIG. 3 is a cutaway view taken along line 3-3 of FIG. 1.
Figure 11:
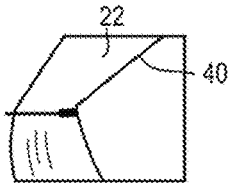
FIG. 11 is a highly schematic environmental view of a second stage of installation.
Figure 13:
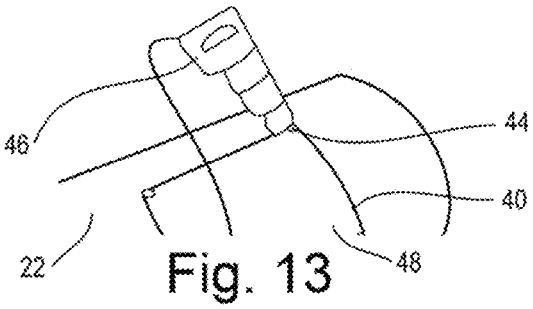
FIG. 13 is a highly schematic environmental view of a fourth stage of installation.
Figure 14:
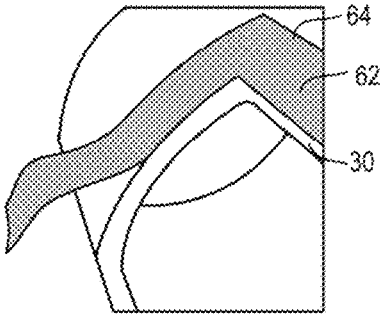
FIG. 14 is a highly schematic environmental view of a fifth stage of installation.

One first step or stage of an example of installing the disclosed manhole assembly 20 onto a pipe 22 is to indicate where on the pipe 22 the manhole assembly 20 is to be installed. One example of this has been generally described. In FIG. 10 the saddle 32 has been placed upon the pipe 22 and a marking implement 34 is used by an installer 38 to place an access hole mark 40 on the pipe 22. This mark 40 can be seen in FIG. 11 as well as in FIG. 12. Once the access hole mark 40 is established, it can be used as a guide in cutting the pipe 22 along the access hole mark 40. To ease in cutting of this line using a reciprocal or other saw, a hole or a plurality of holes 42 may be made (drilled) in the corners of the access hole mark 40 to allow passage of the blade 44 of a saw 46, drill, torch, hot wire, or other tool used by the installer 38 to cut the pipe 22 at the access hole mark 40 as shown in FIG. 13. In other examples, water jets, hot knives, cutting torches, chemical cutters, or other apparatuses may be used to form/cut the access hole 30. Once the pipe 22 has been cut along the access hole mark 40, the center portion 48 may be removed, thus forming the pipe access hole 30 as shown in FIG. 14. As can be seen in FIG. 3 as well as FIG. 9, the pipe access hole 30 in one example is substantially identical in size and geometry and properly aligned with the saddle access hole 50 so as to maximize access and reduce debris collection.

Figure 4:
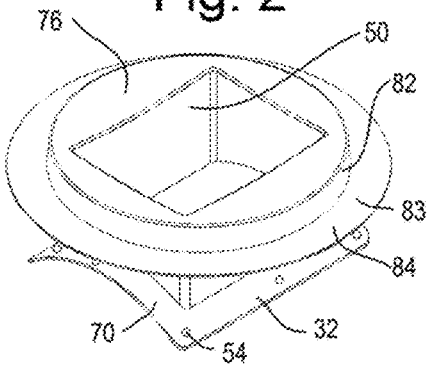
FIG. 4 is an isometric view of the saddle component of the example shown in FIG. 1.
Figure 8:
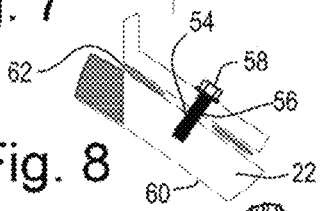
FIG. 8 is an enlarged view of the region 8 of FIG. 1.
Figure 9:
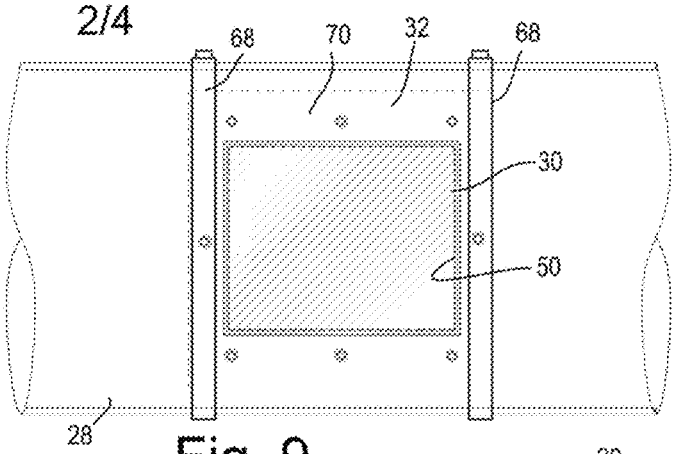
FIG. 9 is a cutaway view taken along line 9-9 of FIG. 1.

Looking to the example shown in FIG. 9, at the installation stage shown in FIG. 10, the access hole mark 40 indicating the pipe access hole 30 is shown on the pipe 22, similar fastener marks 52 may be made on the pipe 22 circumferentially exterior of the mark 40. These fastener marks 52 in one example align with surfaces defining holes 54 in the saddle 32 as indicated in FIG. 4. These fastener marks 52 then locate surfaces defining fastener holes 56 as shown in FIG. 8 through which fasteners 58 may pass. These fasteners 58 may be threaded into the surfaces defining fastener holes 56 or otherwise fixed therein. In one example, it will be desired to have the fastener holes 56 being "blind" holes not passing through the entire pipe 22 and having a bottom surface so as to prohibit passage of fluids from the interior of the pipe 22. In this example, they will not form any obstruction on the interior surface 60 of the pipe 22.

Figure 15:
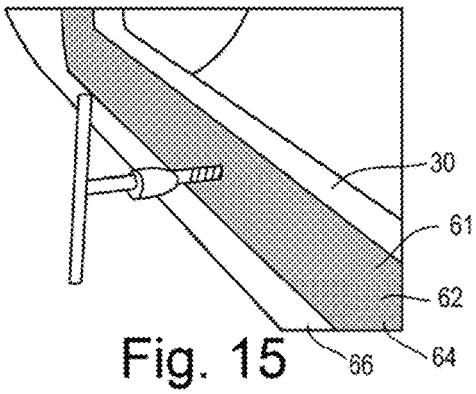
FIG. 15 is a highly schematic environmental view of a sixth stage of installation.
Figure 16:
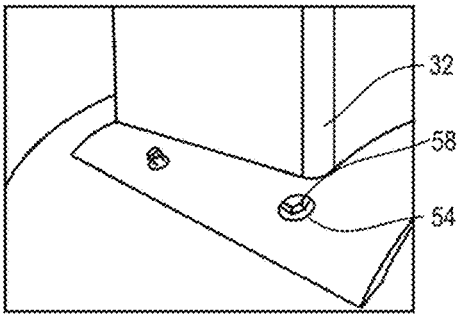
FIG. 16 is a highly schematic environmental view of a seventh stage of installation.

In one example, prior to installing the saddle 32 on to the outer (perimeter) surface 61 of the pipe 22 around the pipe access hole 30, a seal 62 may be provided there between. For example, shown in FIG. 14 and in FIG. 15 a layer of mastic 64 is attached to the exterior surface 66 of the pipe 22 circumferentially around the pipe access hole 30. The mastic 64 forms a seal 62 between the pipe 22 and the saddle 32 to prohibit fluid transfer there between. In some applications, it is environmentally hazardous for the material traversing the pipe 22 to leach into the surrounding ground surface 24. It is often also undesired to have groundwater flow into the pipe 22. Other seals and sealants may be used.

In another example, shown in FIG. 9, a plurality of pipe clamps 68 may encircle the pipe 22. These pipe clamps 68 may lay circumferentially outward of a saddle flange 70 portion of the saddle 32. One such pipe clamp is disclosed in U.S. Pat. No. 3,477,106 incorporated herein by reference. Such pipe clamps or hose clamps and variations thereof are well-known in the art and scalable. When installed, the pipe clamp 68 maintains the saddle 32 in position upon the pipe 22 to ensure correct positioning during installation and optionally remain in place after installation to further secure the saddle 32 thereafter.

Figure 1:
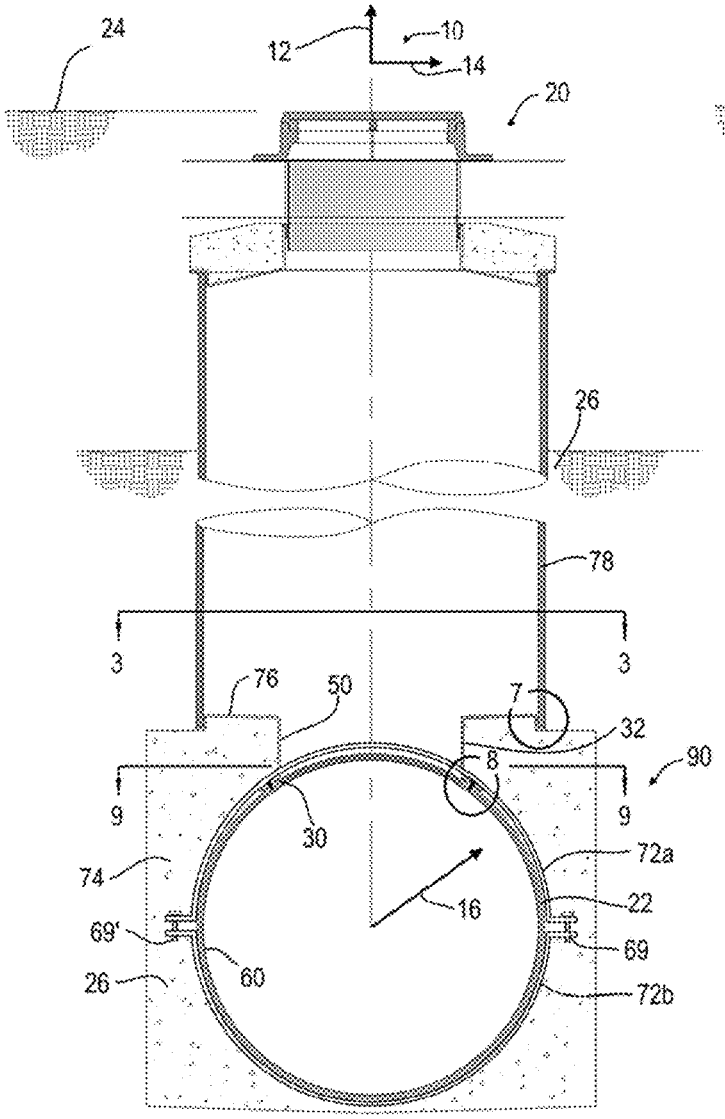
FIG. 1 is a side cutaway view of one example of the disclosed apparatus formed using one example of the disclosed method.
Figure 2:
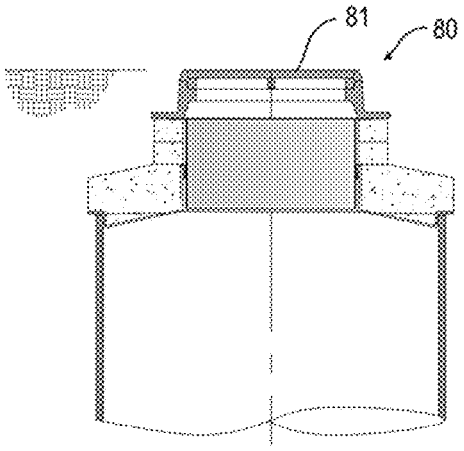
FIG. 2 is another example of a top cap assembly of the apparatus shown in FIG. 1.

In yet another example, generally shown in FIG. 1, a saddle clamp 72 formed of first portion 72*a* and second portion 72*b* is used in place of the pipe clamps 68 shown in FIG. 9. One example of such a saddle clamp is disclosed in U.S. Pat. No. 4,372,017 incorporated herein by reference. In such an example, either the U-bolt portion or the saddle member may be formed integral to the saddle 32 and thus reduce the number of parts required for installation. As is known in the art, either the pipe clamps 68 or the saddle clamp 72 may be tensioned such as to secure the saddle 32 to the pipe 22 and thus in combination with the seal 62 properly position the saddle 32 on the pipe 22 and ensure contaminants do not flow there between.

In other examples, the saddle 32 may be adhesively attached, welded, screwed, bolted, or in other ways fixed to the pipe 22.

In addition, although described herein wherein the pipe access hole 30 is provided prior to installation of the saddle 32, it is understood that the saddle 32 may be installed to the pipe 22 prior to forming the surface defining the pipe access hole 30.

In addition, the pipe 22 and saddle 32 may be prepared as disclosed herein prior to installation of the pipe 22 in the ground or other location.

In one example, the saddle 32 is formed of a monolithic structure such as a polymer, resin impregnated fiberglass, resin impregnated carbon or other fiber, cast metal etc.

Once the saddle 32 is properly fitted to the pipe 22, a volume of grouting material 74 may be disposed into the excavation 26. A concrete form or other retaining structure or system to keep the grouting material 74 around the pipe 22 and saddle 32 until the grouting material 74 hardens or cures to a rigid state thus encapsulating a portion of the pipe 22 and substantial portions of the saddle 32.

In one example previously discussed, the saddle 32 is formed of resin impregnated fiberglass. The grouting material 74 may fill the excavation 26 past the saddle access hole 30 on the exterior of the pipe 22. In one example, the grouting material 74 extends upward to a bench 76 upon which the manhole riser 78 rests. In this way, the grouting material 74 transmits downward forces from the riser 78, cap 80, vehicles driving on the cover 81, etc. through the bench 76 and to the ground surface 24 below the grouting material 74 without substantial stress on the pipe 22. It is conceived in some examples that the saddle 32 has insufficient rigidity or structure by itself to support the weight of the riser 78 and manhole cap assembly 80 including the cover 81. Thus, the grout 74 transmits the forces exerted on the bench 76 and saddle access hole 50 without substantial force or stress on the saddle 32.

Figure 7:
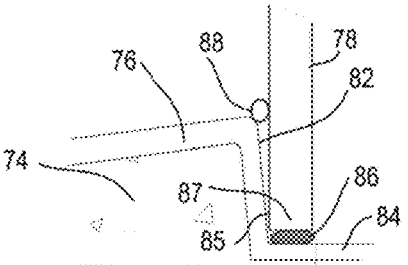
FIG. 7 is an enlarged view of the region 7 of FIG. 1.

Looking to FIG. 4 it can be seen that in this example the saddle 32 comprises the bench 76 previously discussed as well as a saddle spigot 83 formed via a circumferential vertical surface 82 and a circumferential support surface 84. As can be seen in the detail view of FIG. 7 it can be seen that the riser 78 engages the spigot 83 by an inner radially inward surface 85 of the riser 78 contacting the radially outwards vertical surface 82 and a bottom surface 87 resting upon the circumferential support surface 84. In example shown, a seal 86 may be provided between the radially inner surface of the riser 78 and the radially outer surface of the spigot 83 to prohibit fluid flow there between. In addition, a seal 88 as shown in FIG. 7 may be provided. The seals 88 and/or 86 may be provided of a volume of fluid sealant, hardening sealant, or fitted seals such as rubber gaskets etc.

One method of installing the manhole assembly 20 upon a pipe 22 comprises several steps, not necessarily required in the order described, and not all steps are required. In one example, the method comprises the steps of: exposing an exterior surface of a joining section 28 of the pipe; cleaning the joining section of contaminates; cutting a pipe access hole 30 in the joining section. To ensure that fluids do not pass between the saddle and the pipe, a seal 62 may be applied to the pipe around the perimeter surface of the pipe access hole. This seal 62 may be mastic 64 or other material.

Once the pipe is prepared, the assembly may be formed by positioning the saddle 32 adjacent the perimeter surface 61 of the pipe access hole 30 such that the seal 62 is positioned between the saddle 32 and the joining section 28. The saddle 32 in one example having a surface defining a saddle access hole 50 there through, the saddle access hole 50 aligned with the pipe access hole 30 during installation.

The saddle in one example having the spigot 83 in an upper portion thereof. The spigot comprising a support surface 84 upon which the riser 78 rests and a radially outward facing alignment surface 82 which is immediately adjacent the inner radial surface of the riser when assembled.

The saddle 32 in one example has a flange 70 in a lower portion thereof covering the perimeter surface of the pipe access hole 30.

The method of installation may include the step of encapsulating an exterior surface of the flange and the exposed exterior surface of the pipe with the grouting material 74 such as concrete or an equivalent to hold all components in place substantially permanently on the pipe 22, and to transmit compression forced around the pipe 22. These steps forming a base 90 of the manhole assembly 20.

The method may include the step of providing the riser 78 having a bottom surface 87 resting upon the support surface, optionally sealed to the spigot and a radially inward surface 85 engaging the alignment surface.

The method disclosed herein may further comprise the steps of drilling substantially cylindrical holes 56 in the section of pipe for attachment of the saddle 32 to the pipe 22. It may be desired to include a step of tapping the holes so as to form female threads therein; and installing male threaded bolts 58 through a flange of the saddle 32 into the substantially cylindrical holes 42 in the section of pipe 22.

The method as recited herein may further comprise a step of installing a clamp 68/72 around the saddle 32 and the pipe 22, and radially tensioning the clamp so as to affix the saddle 32 of the pipe 22.

In one example the clamp is a saddle clamp 72. Such a saddle clamp 72 comprising a first portion 72*a* and a second portion 72*b* tensioned around the pipe 22 and saddle 32 by way of one or more tensioning members. In one example, the first portion 72*a* and/or second portion 72*b* may be coupled to or formed with the saddle 32.

The method as recited herein may alternatively be arranged wherein the clamp is a pipe clamp 68. A tensioning member 69 or 69' may be used to reduce the circumferential size of the pipe clamp 68 and secure the saddle 32 to the pipe 22.

Figure 20:
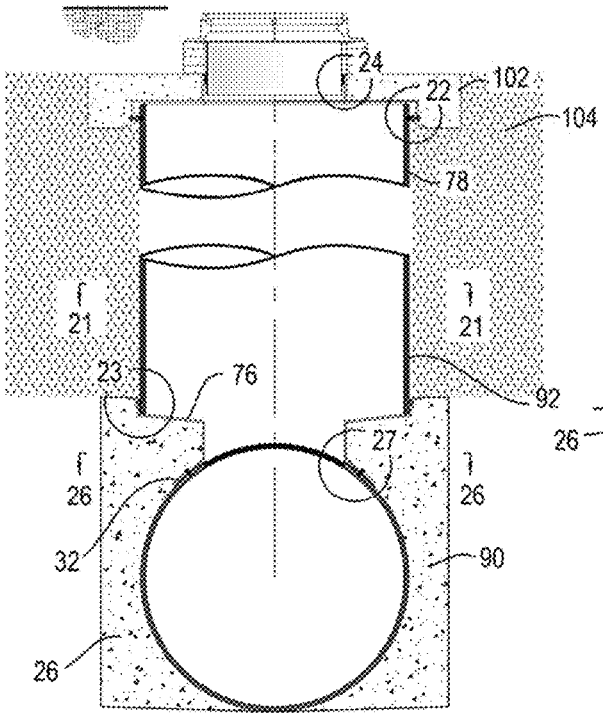
FIG. 20 is a side cutaway view of one example of the disclosed apparatus formed using the disclosed method.
Figure 22:
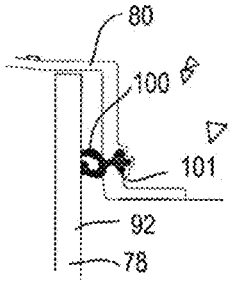
FIG. 22 is an enlarged detail view of the region 19 of FIG. 17.
Figure 23:
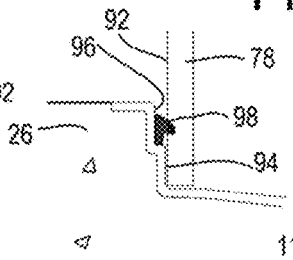
FIG. 23 is an enlarged view of the region 20 of FIG. 17.
Figure 24:
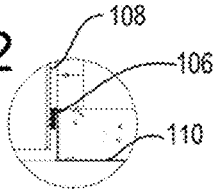
FIG. 24 is an enlarged view of the region 21 of FIG. 17.

In another example, shown in FIG. 20 with detail shown in FIG. 22-24, the riser 78 has a radially outward surface 92 which engages a radially inward surface 94 of an alignment surface 96 of the saddle 32. In such an example, a malleable gasket 98 may be utilized to seal the surfaces 94-96. Such gaskets often made of hardened or vulcanized rubber, cured silicone, or other resilient materials. In other examples, mastic, high viscosity fluids, solidifying fluids, or similar seals may be used in place of the gasket 98.

FIG. 20 and FIG. 22 also show an example with a circumferential seal 100 sealing between the manhole cap assembly 80 and the inner surface 92 of the manhole riser 78. This example resulting in a radially outward extension 102 of the manhole cap assembly 80 radially outward of the riser 78. In this example the radial extension 102 may rest upon the backfill 104 after the excavation 26 is filled following installation of the manhole base 90 and riser 78. This arrangement transfers at least some of the weight of the manhole cap assembly 80 and items (vehicles) thereupon to the backfill 104 and not to the riser 78 nor to the base 90. In this example, the circumferential seal 100 is held in place relative to the manhole cap assembly 80 my way of a seal receiver 101 which may be a plurality of holes through a portion of the manhole cap assembly 80. A portion of the seal 100 passes through these holes/receiver.

FIG. 24 shows a similar circumferential gasket 106 positioned between a telescoping access collar 108 and a slab component 110. This circumferential gasket 106 seals the access collar 108 to the slab component 110 while allowing movement there between.

Figure 25:
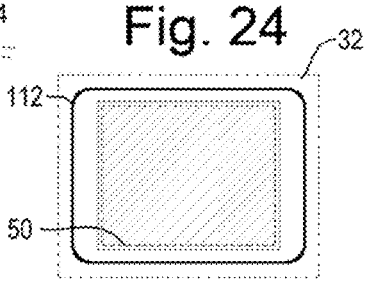
FIG. 25 is a bottom view of one example of a flanged saddle as show in FIG. 4.
Figure 21:
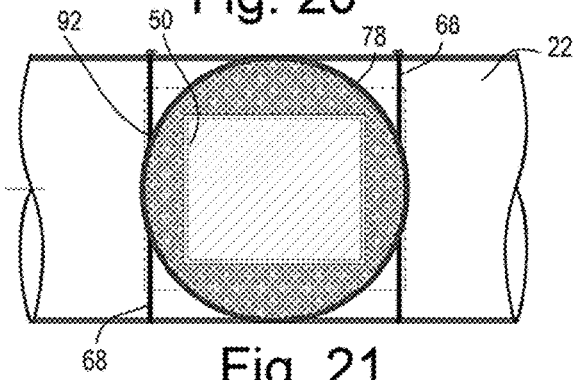
FIG. 21 is a cutaway view taken along line 18-18 of FIG. 17.
Figure 26:
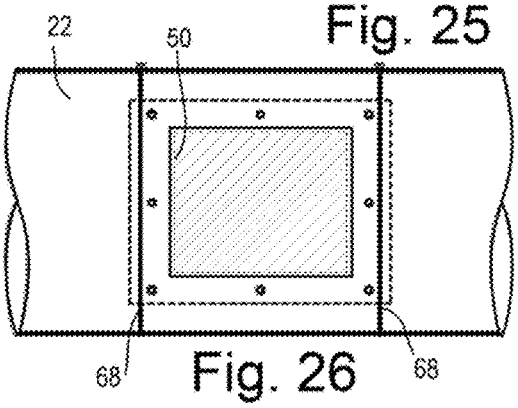
FIG. 26 is a cutaway view taken along line 23-23 of FIG. 17.
Figure 27:
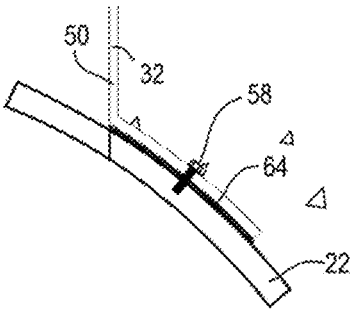
FIG. 27 is an enlarged view of the region 24 of FIG. 17.
Figure 28:
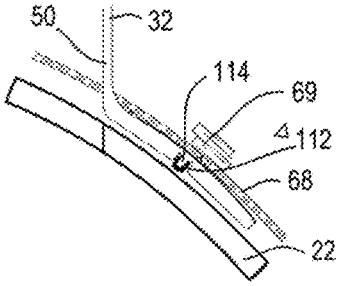
FIG. 28 is another example of the structure shown in FIG. 24.
Figure 29:
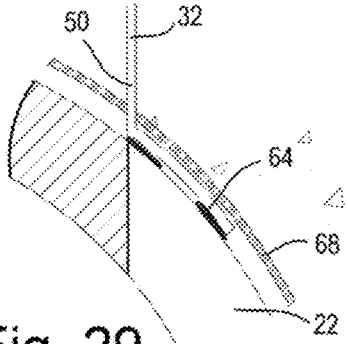
FIG. 29 is another example of the structure shown in FIG. 24.

As previously described, the saddle 32 may be attached to the pipe 22 by way of fasteners 58 as shown in FIG. 27, by way of clamps 68 as shown in FIGS. 28 and 29, or a combination thereof. In addition, a mastic seal 64 when used forms a fluid tight connection between the saddle 32 and the pipe 22 as shown in FIG. 27 or the seal/masticas shown in FIG. 29. Alternatively, or additionally a gasket 112 as shown in FIG. 25 and in FIG. 28 may be utilized. For ease in installation, the gasket 112 may be attached to a receiver 114 such as a detent or groove in the saddle 32 to ensure proper positioning of the gasket 112.

Figure 17:
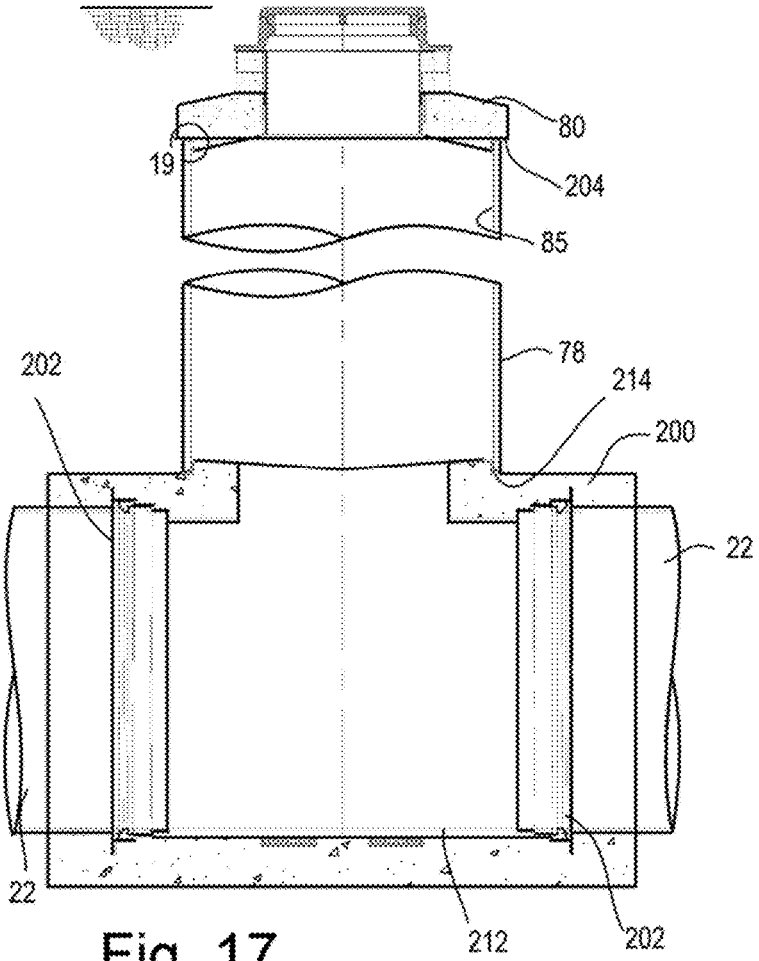
FIG. 17 is a side cutaway view of one example of the disclosed apparatus formed using the disclosed method.
Figure 19:
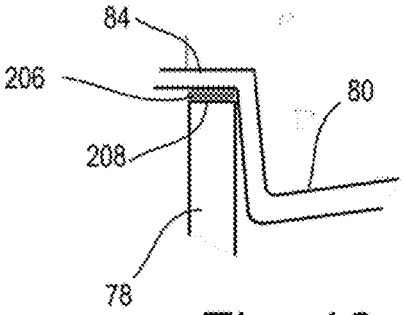
FIG. 19 is a detail view of the region 18 of FIG. 17.
Figure 18:
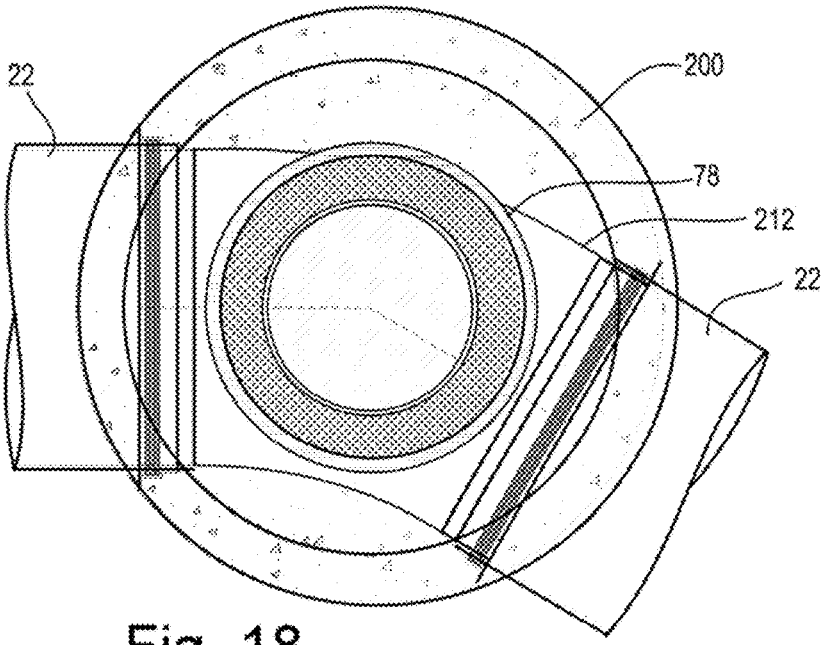
FIG. 18 is a top view of the example shown in FIG. 17.

FIGS. 17-19 show another example that may be used with the previously disclosed examples. These include a base 200 comprising bell connectors 202 which connect to the pipe 22. The bell connectors 202 may be fixed to or formed integral with a main body 212 which may be generally cylindrical, with a riser support 214 extending therefrom and supporting the riser 78. In FIG. 18 it can be seen that the main body may be curved or arcuate as needed for particular installations. In this example, the base 200 may be pre cast with or without the bell connectors 202 and/or riser support section 214 and delivered to the site, or may potentially be cast in place around the pipe 22 at the site.

The example of FIG. 17-18 shows the riser 78 attached to the base 200 in the same manner as described relative to FIG. 1, with the manhole cap assembly 80 resting on the top edge 204 of the riser 78 and engaging the radially inner surface 85 and/or radially outer surface thereof.

FIG. 19 also shows a seal 206 or gasket between the upper surface 208 of the riser 78 and a support surface 210 of a spigot portion of the manhole cap assembly 80. This further hindering fluid passage between the two components. The same seal 206 may be used as depicted in FIG. 8 and described above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A method for installing a manhole assembly upon a pipe comprising the steps of:

exposing an exterior surface of a joining section of the pipe;

cleaning the joining section of contaminates;

cutting a pipe access hole in the joining section;

applying a seal to the pipe around the perimeter surface of the pipe access hole;

positioning a saddle adjacent the perimeter surface of the pipe access hole such that the seal is positioned between the saddle and the joining section;

the saddle having a surface defining a saddle access hole there through, the saddle access hole aligned with the pipe access hole;

the saddle having a vertical pipe connection surface in an upper portion thereof; the vertical pipe connection surface a support surface;

an alignment surface;

the saddle having a flange in a lower portion thereof covering the perimeter surface;

encapsulating an exterior surface of the flange and the exposed exterior surface of the pipe with a grouting material; and providing a riser having a bottom surface resting upon the support surface of the saddle and a radially inward surface engaging the alignment surface.

2. The method as recited in claim 1 further comprising the steps of:

drilling substantially cylindrical holes in the section of pipe;

tapping the holes; and installing threaded bolts through a flange of the saddle into the substantially cylindrical holes in the section of pipe.

3. The method as recited in claim 1 further comprising the steps of:

installing a clamp around the saddle and the pipe, and radially tensioning the clamp so as to affix the saddle to the pipe.

4. The method as recited in claim 3, wherein the clamp is a saddle clamp.

5. The method as recited in claim 3 wherein the clamp is a pipe clamp.

6. The method as recited in claim 1 wherein the vertical pipe connection surface is a spigot having a radially outward alignment surface adjacent a radially inward surface of the pipe.

7. The method as recited in claim 1 wherein the vertical pipe connection surface is a radially inward alignment surface adjacent a radially outward surface of the pipe.

* * * * *